United States Patent [19]

Head

[11] 4,347,658

[45] Sep. 7, 1982

[54] METHOD OF MAKING MAGNETIC REED CONTACT UNIT

[75] Inventor: Brian E. Head, Bexley, England

[73] Assignee: International Standard Electric Corporation, New York, N.Y.

[21] Appl. No.: 161,822

[22] Filed: Jun. 23, 1980

[30] Foreign Application Priority Data

Jul. 31, 1979 [GB] United Kingdom ..... 7926703

[51] Int. Cl.[3] ..... H01H 11/00

[52] U.S. Cl. ..... 29/602 R; 29/622; 29/756; 65/59.23; 65/59.27; 65/135; 65/139; 65/DIG. 12

[58] Field of Search ..... 29/602 R, 622, 756; 65/DIG. 12, 139, 138, 155, 59.23, 59.27

[56] References Cited

U.S. PATENT DOCUMENTS

| | | | |
|---|---|---|---|
| 3,273,989 | 9/1966 | Gubitose et al. | 29/756 X |
| 3,369,291 | 2/1968 | Shaffer, Jr. et al. | 29/756 X |
| 3,537,276 | 11/1970 | Pityo | 29/622 X |
| 3,628,242 | 12/1971 | Zollman | 29/756 X |

*Primary Examiner*—Carl E. Hall

*Attorney, Agent, or Firm*—John T. O'Halloran; Peter C. Van Der Sluys

[57] ABSTRACT

Reed switch contact unit is made in a sealed box and a pivotally-mounted guide member (7) with a V- or Y-shaped slot aligning the bottom reed during assembly.

7 Claims, 9 Drawing Figures

METHOD OF MAKING MAGNETIC REED CONTACT UNIT

BACKGROUND OF THE INVENTION

This invention relates to an apparatus and method for use in the manufacture of magnetic reed contact units.

British Pat. No. 1,464,406 describes the assembly of a magnetic reed contact unit during which the upper magnetic reed is held in a clamp while the lower magnetic reed is supported solely by magnetic attraction from the upper reed across the air gap of a magnetic circuit. In order to align the remote end of the lower reed, a magnetic pin forms one pole of the magnetic circuit and thus localizes magnetic influence on the remote end of the lower reed to align the lower end very accurately with the tip of the pin.

With the advent of a longer magnetic reed contact unit, we tried to modify our existing equipment by shortening the length of the magnetic pin but without success. We believe the shorter pin was not localizing the magnetic influence sufficiently with the result that the alignment of the lower reed could not always be guaranteed.

Various other arrangements have been proposed to align the overlapped reeds, including British Pat. No. 1,013,913 which has clamps for supporting both the upper and lower reeds and British Pat. No. 1,106,379 which shows gripping jaws which hold the reeds. In both cases one reed is eventually magnetically supported from the other reed and during the magnetic supporting, no further alignment mechanism is utilized to maintain the reeds in axial alignment. All these arrangements are relatively complicated or do not guarantee good alignment particularly during the critical sealing process when the reeds are sealed through the ends of the glass envelope.

DESCRIPTION OF THE INVENTION

According to the present invention, there is provided a method of making a sealed magnetic reed contact unit comprising holding a first reed, supporting a second reed from the first by magnetic attraction between overlapped adjacent ends of the reeds and aligning the second reed with the first reed by locating the remote end of the second reed in a forked guide member, any nearby magnetic influence on the remote end of the second reed being minimized if not eliminated, and sealing the reeds through the wall of an enclosure member.

Preferably, the guide member is movable and the enclosure member is positioned around the two reeds when the guide member is in a retracted position. Preferably also, the guide member is in a forward position to align the second reed as the second reed is placed in contact with the first reed. Subsequently, the guide member can be retracted when the enclosure member is positioned. The guide member can be moved into a forward position after the enclosure member has been positioned around the two reeds, to align or maintain alignment of the second reed during the sealing process.

According to a further aspect of the present invention, there is provided apparatus for making a sealed magnetic reed contact unit comprising a sealed chamber, means for holding a first reed, means for establishing a magnetic field whereby a second reed can be supported from the first reed by magnetic attraction between overlapped adjacent ends the reeds, a forked guide member for aligning the second reed with the first reed by locating the remote end of the second reed, any nearby magnetic influence on the remote end of the second reed being minimized if not eliminated, means for supporting an open ended enclosure member with the remote ends of the reeds projecting from the open ends, and means for closing the open ends and sealing the reeds through the closed ends of the enclosure members in a controlled atmosphere within the sealed chamber.

BRIEF DESCRIPTION OF THE DRAWINGS

In order that the invention can be clearly understood, reference will now be made to the accompanying drawings in which.

DESCRIPTION OF THE PREFERRED EMBODIMENT

Figure 1:
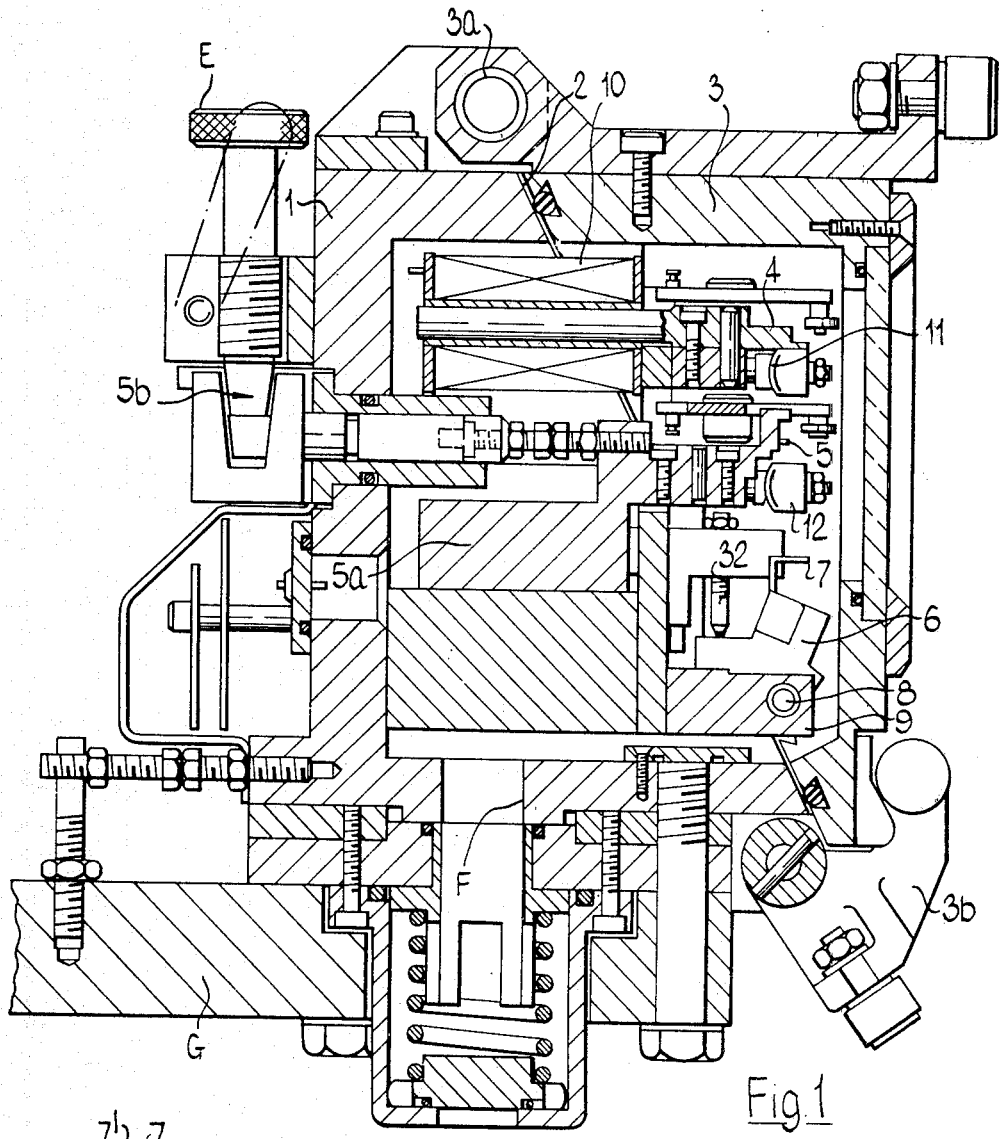
FIG. 1 is a section, partly schematic, through an assembly box of a reed contact unit manufacturing machine.

Referring now to FIG. 1, the assembly head for manufacturing reed contact units is shown schematically. The head consists of a box 1 having an inclined opening 2 closed and sealed by a front cover 3 pivoted at *3a* and held closed by a roller lock *3b*. The box is mounted on a table G and access for inert gas is via entrance F.

Inside the box is an upper clamp 4 for clamping the upper reed (not shown), a further clamp 5 for clamping the tubular glass envelope (also not shown) and a pivotally mounted part 6 carrying a forked guide member 7 for aligning the remote lower end of the lower reed. The part 6 is pivotally mounted at 8 on a block 9 fixed to the box.

The upper clamp 4 is magnetized by means of an electromagnet 10 and care has been taken to ensure that there is minimal external magnetic influence in the region of the part 6 and the guide member 7 which might otherwise affect the alignment of the lower reed. For example, the parts 6 and 7 and the block 9 are made of non-magnetic material, such as brass or phosphor bronze. The box itself is made of aluminum and the transparent front is of glass.

Also shown within the box are reflectors 11 and 12 which reflect heat from external radiant sources for sealing the two ends of the tubular glass envelope.

Figure 2:
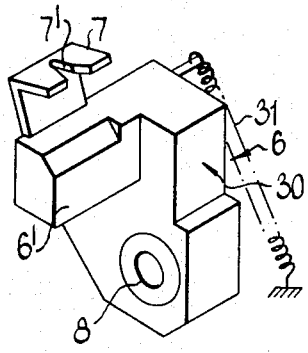
FIG. 2 shows in greater detail on an enlarged scale a part of the mechanism of FIG. 1; and FIGS. *3a* to *3g* show the steps in the assembly process of a reed contact unit.

The mechanism and operation of the various parts within the box will not be described in detail although the part 6 is shown in greater detail in FIG. 2.

Referring to FIG. 2, the main body of the part 6 is made of brass and carries a phosphor bronze guide member 7 secured to the body 6 by, for example, a screw (not shown). The guide member 7 has a V-shaped notch 7' so that when relative movement takes place between the remote end of the lower reed and the part 7 the lower end is automatically guided centrally of the notch and is held in a central aligned position so long as the end of the reed lies within the root of the V-shaped notch 7'. A pusher external to the box cavity indicated by reference numeral 30 in FIG. 2 but not shown in the drawing in detail, pushes the body 6 to pivot it to its retracted position. An overcenter spring 31 returns the body 6 to its forward position, determined by a stop member 32 showing FIG. 1. Thus the body 6 is only movable while the box is open.

Referring now to FIGS. 3*a* to 3*g* the series of steps in the process of making the reed contact unit will now be described. In FIGS. 3*a* to 3*g*, the parts are shown schematically and corresponding to more detailed parts shown in FIGS. 1 and 2 carry the same reference numerals.

Figures 3A, 3B, 3C, 3D, 3E, 3F, 3G:
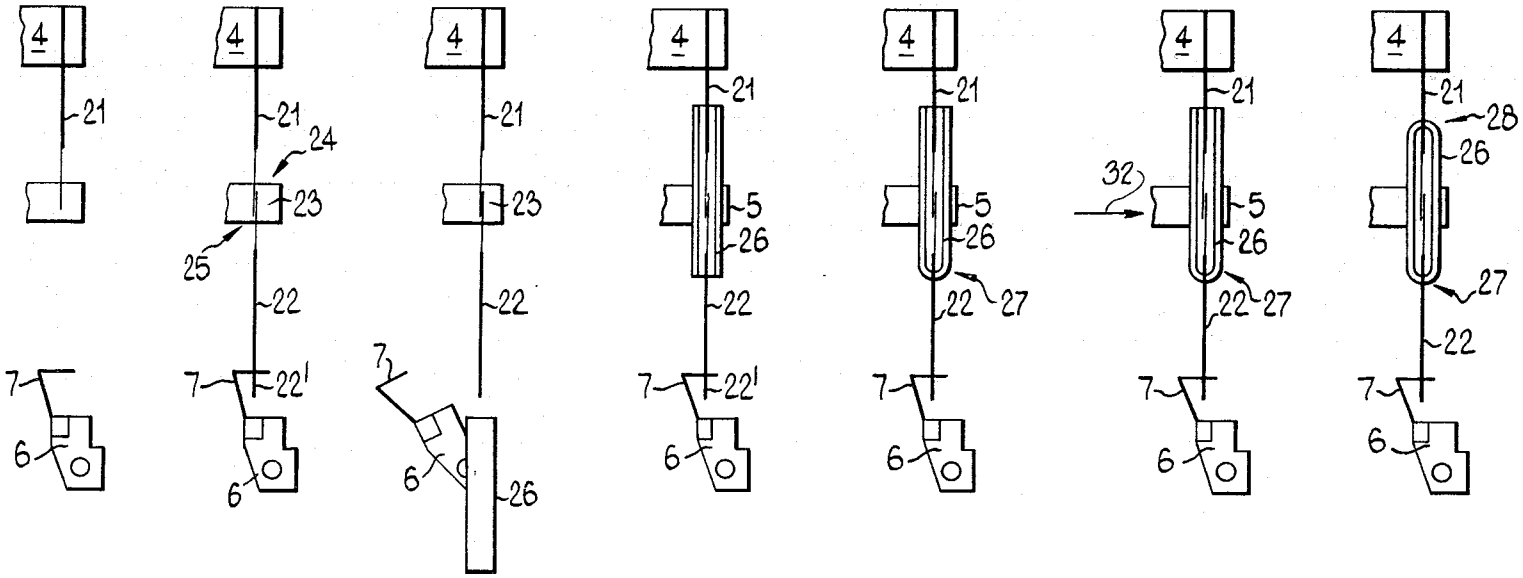

In FIG. 3*a*, initially the top blade 21 is clamped in the upper clamp 4. Then the bottom blade 22 is offered up so that the ends of blades 22 and 21 just overlap, the electromagnet 10 having been energized so that blade 22 is supported magnetically from blade 21. The overlapped ends 23 are lightly "patted" on either side by fingers (not shown but indicated schematically by the diagonally drawn arrows 24 and 25. This ensures that the overlapped ends of the blades lie exactly one on top of the other. The lower remote end 22' is located in the V-shaped slot 7' and is thus exactly aligned with the blade 21 in a plane normal to the paper. The abutting surfaces of the overlapped ends 23 define the alignment of the two reeds fore and aft in the plane of the paper. This is shown in FIG. 3*b*.

Referring to FIG. 3*c* the pivoted part 6 is moved backwards by the pusher in direction of arrow 30 (FIG. 2) so that the arm portion 6' of the body 6 together with the guide member 7 is moved clear of the bottom blade 22 and an open-ended glass envelope 26 is introduced beneath the two reeds and is moved up around the position of the overlapped ends 22, as shown in FIG. 3*d*. The open ended glass envelope is held in position by the clamp 5. As shown in FIG. 3*d*, the guide member 7 and body 6 are pivoted forward so that once again the V-shaped slot 7' locates the lower remote end 22' of the bottom reed.

The box is now closed and sealed and referring to FIG. 3*e*, the lower blade is sealed to the lower end of the envelope 26 as indicated by the arrow 27. During this time, the lower blade is still located in the V-shaped groove 7'. An inert gas is introduced into the box prior to sealing. Our copending application Ser. No. 39,067 filed May 14, 1979 now U.S. Pat. No. 4,236,908 describes an improvement in this technique.

Then as indicated in FIG. 3*f*, the required gap between the overlapped ends of the blades is created by moving the clamp 5 forward in the direction of arrow 32 by the desired amount taking the now sealed lower reed 22 with it.

Finally, as shown in FIG. 3*g*, the upper seal 28 is formed thus sealing the upper reed into the upper end of the envelope 26.

During this procedure, other process steps take place, for example the introduction of inert gas into the closed chamber to flush the chamber of ordinary air.

Most of the process steps noted above are carried out at different discrete locations on a rotary type machine and further details of such a machine including the arrangement by which the various services are fed to the sealed chamber, are described in our copending Patent Application 21104/77.

Body 5*a* shown only schematically carries clamp 5 and slides in bearings (not shown). Movement is caused by a tapered peg arrangement 5*b*.

What is claimed is:

1. A method of making a sealed magnetic reed contact unit comprising holding a first reed, supporting a second reed from the first by magnetic attraction between overlapped adjacent ends of the reeds and aligning the second reed with the first reed by moving the remote end of the second reed in the plane of the overlapped ends by locating the remote end in a forked guide member, any nearby magnetic influence on the remote end of the second reed being minimized if not eliminated, and sealing the reeds through the wall of an enclosure member.

2. A method as claimed in claim 1, wherein the guide member is movable and the enclosure member is positioned around the two reeds when the guide member is in a retracted position.

3. A method as claimed in claim 2, wherein the guide member is in a forward position to align the second reed as the second reed is placed in contact with the first reed, the guide member is retracted, and the enclosure member is positioned around the aligned reeds.

4. A method as claimed in claim 2 or claim 3, wherein the guide member is moved into a forward position after the enclosure member has been positioned around the two reeds, to align or maintain alignment of, the second reed.

5. Apparatus for making a sealed magnetic reed contact unit comprising a sealed chamber, means for holding a first reed, means for establishing a magnetic field whereby a second reed can be supported from the first reed by magnetic attraction between overlapped adjacent ends of the reeds, a forked guide member for aligning the second reed with the first reed by moving the remote end of the second reed in the plane of the overlapped ends by locating the remote end in the forked guide member, any nearby magnetic influence on the remote end of the second reed being minimized if not eliminated, means for supporting an open ended enclosure member with the remote ends of the reeds projecting from the open ends, and means for closing the open ends and sealing the reeds through the closed ends of the enclosure member in a controlled atmosphere within the sealed chamber.

6. Apparatus as claimed in claim 5, wherein the guide member is movable.

7. Apparatus as claimed in claim 6, wherein the guide member is pivotally mounted.

* * * * *